US006807930B2

(12) United States Patent
Budde et al.

(10) Patent No.: US 6,807,930 B2
(45) Date of Patent: Oct. 26, 2004

(54) ACTUATING DRIVES FOR VALVE DRIVES HAVING A VARIABLY ADJUSTABLE STROKE, FOR VALVES OF INTERNAL COMBUSTION ENGINES

(75) Inventors: Roger Budde, Chemnitz (DE); Andreas Werler, Zwickau (DE)

(73) Assignee: IAV GmbH Ingenieurgesellschaft Auto und Verkehr, Berlin (DE)

( * ) Notice: Subject to any disclaimer, the term of this patent is extended or adjusted under 35 U.S.C. 154(b) by 0 days.

(21) Appl. No.: 10/773,737

(22) Filed: Feb. 6, 2004

(65) Prior Publication Data

US 2004/0159294 A1 Aug. 19, 2004

(30) Foreign Application Priority Data

Feb. 17, 2003 (DE) ..... 103 06 907

(51) Int. Cl.[7] ..... F01L 1/34
(52) U.S. Cl. ..... 123/90.16; 123/90.15
(58) Field of Search ..... 123/90.15, 90.16

(56) References Cited

U.S. PATENT DOCUMENTS 6,016,779 A * 1/2000 Nemoto et al. ..... 123/90.16

FOREIGN PATENT DOCUMENTS

DE 199 13 742 9/2000

DE 199 60 742 6/2001

OTHER PUBLICATIONS

"Variable Ventilsteuerung" [Variable Valve Control]/ Stefan Pischinger; expert–Verlag 2002; ISBN 3–8169–2119–1; p. 84, Figure 6.

* cited by examiner

*Primary Examiner*—Thomas Denion
*Assistant Examiner*—Zelalem Eshete
(74) *Attorney, Agent, or Firm*—Collard & Roe, P.C.

(57) ABSTRACT

An actuating drive for valve drives having a variably adjustable stroke, for actuating valves of internal combustion engines is provided, which can be arranged in cylinder heads having usual dimensions, next to the valve activation mechanisms, in advantageous manner. The element that is changeable in its angle position is provided with a guide toggle coupled in fixed rotational manner, which is in engagement with an actuating shaft arranged adjacent to it, guided in the cylinder head in displaceable manner. This actuating slide has an actuating bridge in the region of the actuating path, with which contact surfaces of the actuating lever are engaged on one or both sides. The actuating slide is coupled with an actuating motor, which effects the axial actuating movements of the actuating slide counter to the forces introduced by the actuating lever. It is advantageous if the actuating slide is arranged on the side of the cylinder head opposite the camshaft, and thereby fits advantageously into the usual design of cylinder heads.

7 Claims, 5 Drawing Sheets

ACTUATING DRIVES FOR VALVE DRIVES HAVING A VARIABLY ADJUSTABLE STROKE, FOR VALVES OF INTERNAL COMBUSTION ENGINES

CROSS REFERENCE TO RELATED APPLICATIONS

Applicants claim priority under 35 U.S.C. §119 of German Application No. 103 06 907.0 filed Feb. 17, 2003.

BACKGROUND OF THE INVENTION

1. Field of the Invention

The present invention relates to actuating drives for valve drives having a variably adjustable stroke, for actuating valves of internal combustion engines.

2. The Prior Art

Actuating drives in variable valve drives for an element that is to be pivoted, which determines the valve stroke with its angle position and is coupled with an actuating drive arranged lengthwise or crosswise to the crank shaft axis by way of toggle joints, are previously known. In these embodiments, a lever is always connected with the element that determines the valve stroke, in fixed rotational manner and axially guided, and can be pivoted together with this element.

The actuating drive has an actuating motor that drives a threaded spindle on which an actuating nut is arranged in fixed rotational manner, so as to be moved axially. In each case, one of the toggle joints is connected with the actuating nut in articulated manner, so as to pivot.

In this embodiment, with the actuating drive arranged crosswise to the crank shaft axis, the toggle joints are coupled by way of a rotational joint, while in the embodiment having an actuating drive arranged parallel to the crank shaft axis, the toggle joints are coupled by w ay of a ball joint. DE literature "Variable Ventilsteuerung" [Variable valve control]; Stefan Pischinger; expert-Verlag 2002; ISBN 3-8169-2119-1; p. 84, FIG. 6.

Because of the use of toggle joints that work together, such actuating drives take up a lot of room in the cylinder head.

SUMMARY OF THE INVENTION

It is therefore an object of the present invention to provide actuating drives for valve drives having a variably adjustable stroke, of the type described above, which can be arranged in cylinder heads having usual dimensions, next to the valve activation mechanisms, in an advantageous manner.

This object is achieved by an actuating drive wherein the element that is changeable in its angle position is provided with an actuating lever that is coupled in fixed rotational manner, which is in engagement with an actuating slide that is g sided to be displaced and pivoted in the cylinder head arranged adjacent to it. The actuating slide that can be displaced by an actuating motor has an actuating bridge on which the actuating lever rests on both sides and determines its angle position in its guidance in the cylinder head. These features, and their arrangement relative to one another provide an improved actuating drive.

In order to adjust the element that can be changed in terms of its angle position, the changeable element is provided with a guide toggle coupled in fixed rotational manner which, according to the invention, is in engagement with an actuating shaft arranged adjacent to it, guided in the cylinder head in displaceable manner.

This actuating slide has an actuating bridge in the region of the actuating path, with which contact surfaces of the actuating lever are engaged on one or both sides.

The actuating slide is coupled with an actuating motor, which effects the axial actuating movements of the slide counter to the forces introduced by the actuating lever. It is advantageous if the actuating slide is arranged on the side of the cylinder head opposite the camshaft, and it thereby fits advantageously into the usual design of cylinder heads.

It is advantageous if the control surface or control surfaces of the actuating bridge present on the actuating slide are designed so that the change in stroke decreases in proportion to the actuating path, when adjustments are made in the direction of the maximum stroke. This results in a more precise adjustment, on the one hand, and in a higher translation for the adjustment in the range of forces with a greater effect, in the case of a great or maximal valve stroke, on the other hand.

It is advantageous if the spring that engages on the intermediate member is supported on the changeable element. In this way, the force of the latter effects a torque or support moment in the direction of an adjustment towards a greater stroke, on the changeable element. With this spring arrangement, it is possible to reduce the required actuating forces.

Advantageous embodiments will be explained in the description below, in connection with their effects.

BRIEF DESCRIPTION OF THE DRAWINGS

Other objects and features of the present invention will become apparent from the following detailed description considered in connection with the accompanying drawings. It should be understood, however, that the drawings are designed for the purpose of illustration only and not as a definition of the limits of the invention.

In the drawings, wherein similar reference characters denote similar elements throughout the several views.

DETAILED DESCRIPTION OF PREFERRED EMBODIMENTS

Figure 1:
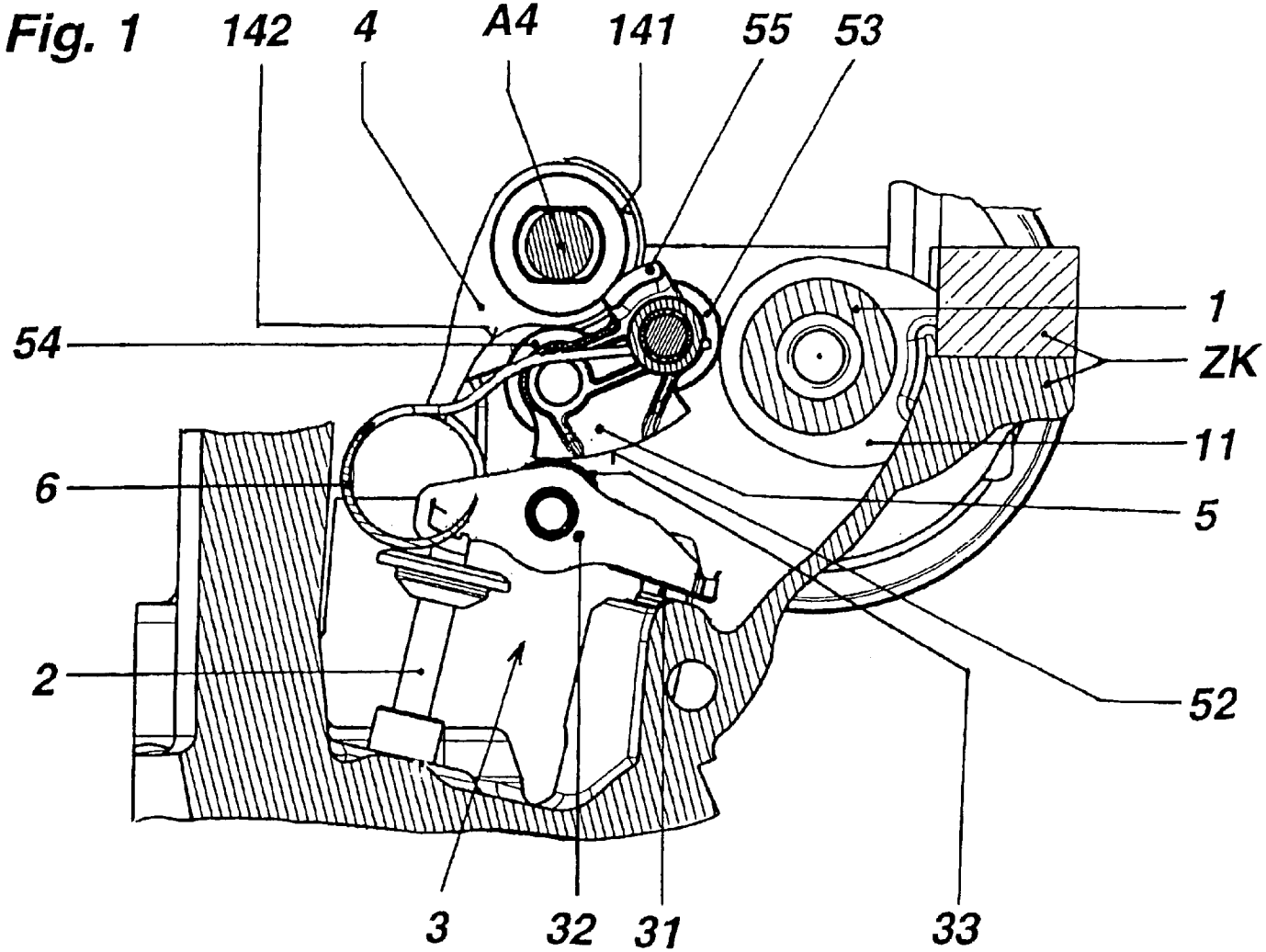
FIG. 1 shows a representation of a valve drive for the variable activation of valves, in which an actuating drive according to the invention is used.

FIG. 1 shows a valve drive for variable activation of valves by means of cams, preferably for internal combustion engines. A camshaft 1 driven by a crank shaft, if applicable by way of an angle setting device, is rotatably mounted with a fixed axial position in the cylinder head ZK. Camshaft 1 has a fixed position relative to valves 2 and their related stroke translation or transfer arrangement 3. Valves 2, which close by means of spring force, are arranged in cylinder head ZK. A stroke transfer arrangement 3 guided in a fixed position is assigned, in each instance, to valves 2, and this arrangement is preferably provided with a play equalization element 31.

An element 4 that is changeable in its position is arranged in a fixed position in cylinder head ZK, but so as to pivot about a pivot axis A4, which is in a fixed position, for the purpose of adjusting the valve stroke.

An intermediate member a is guided on the inside on the element 4 that is changeable in its position, by way of a roller 54 mounted on it, and a glide support 55. This arrangement results in prismatic support of intermediate member 5 in all positions during its movement.

In addition, intermediate member 5 is in engagement with a cam 11 of camshaft 1 mounted in cylinder head ZK with a roller 53 mounted on it, and with stroke transmission arrangement 3 assigned to valve 2 with its outside contour 52, by way of a roller 33 of roller lever 32.

Element 4 which is changeable in its position has a support cam 141 and a control cam 142, preferably formed by an arc about pivot axis A4, that extend on the circumference, one after the other. Intermediate member 5 is supported on cams 141, 142, in the manner already described, during the stroke movement, with a non-positive lock.

Intermediate member 5 is under the effect of a spring 6, the direction of effect of which holds intermediate member 5 in engagement with cam 11 and changeable element 4.

Figure 2:
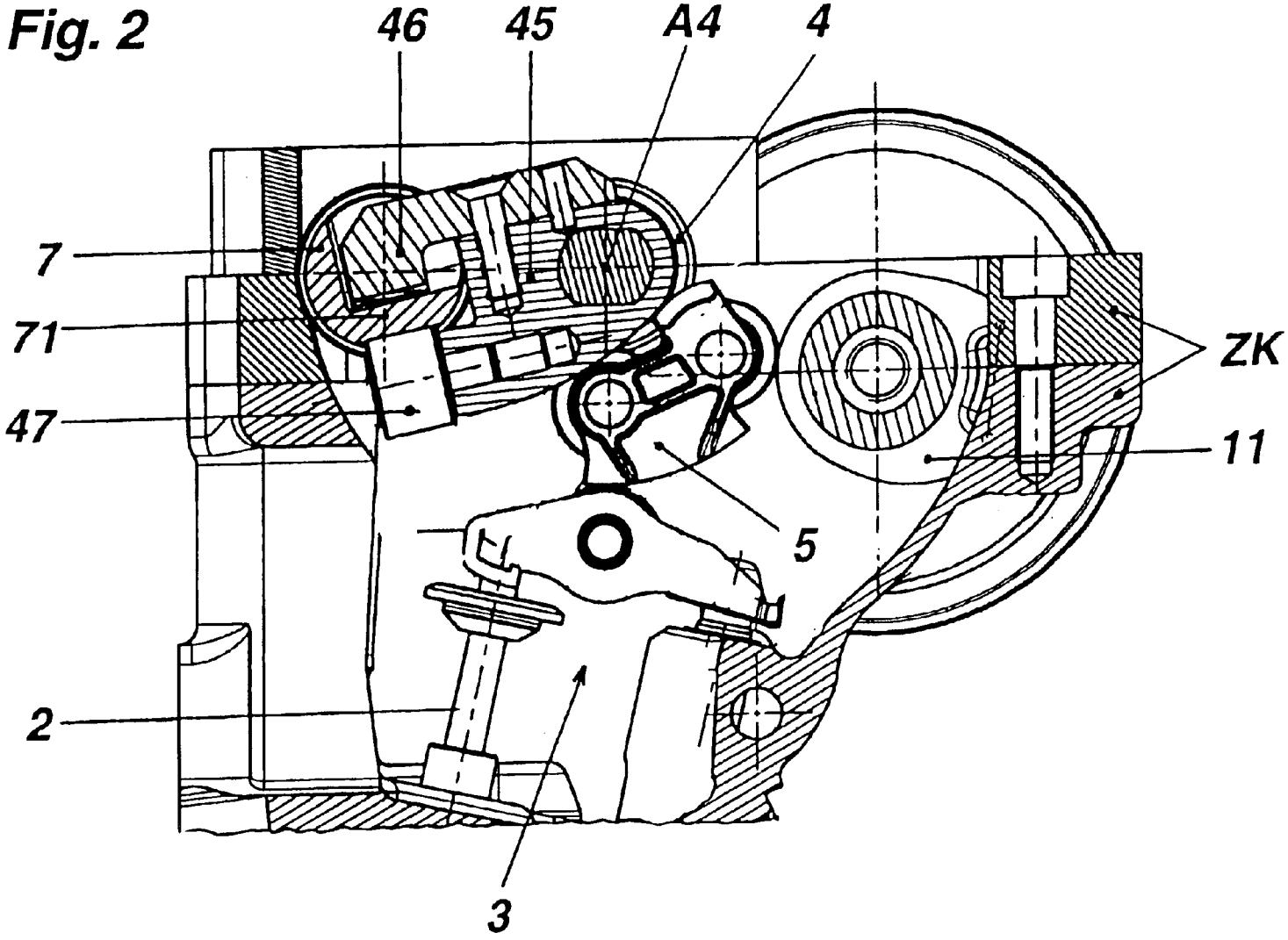
FIG. 2 shows a transverse cross-sectional representation of an actuating drive according to the invention, for moving an element which is changeable in its position, which effects the maximum stroke of the valve in this representation.

FIG. 2 shows an actuating lever 45 that is seated on a pivot axis A4 with changeable element 4 and is connected in fixed rotational manner. It has a roller 47 and a counter-bearing arm 46, and is in engagement with an actuating slide 7 that can be displaced axially, by means of roller 47 and counter-bearing arm 46. Roller 47 and counter-bearing arm 46 are in contact with actuating slide 7, by way of the control surfaces 74 of a control bridge 71 of actuating slide 7, which surfaces run parallel.

An embodiment with only one control surface 74, at which roller 47 engages, is also possible, because forces transferred by actuating lever 45 always act fundamentally in the same direction, and therefore guarantee non-positive lock contact of roller 47 on control surfaces 74 of actuating bridge 71 that are assigned to it.

It is advantageous if actuating slide 7 fits in on the side of the cylinder head opposite camshaft 1, so that the cylinder head and the cylinder head cover can be constructed with the usual dimensions.

Figure 3:
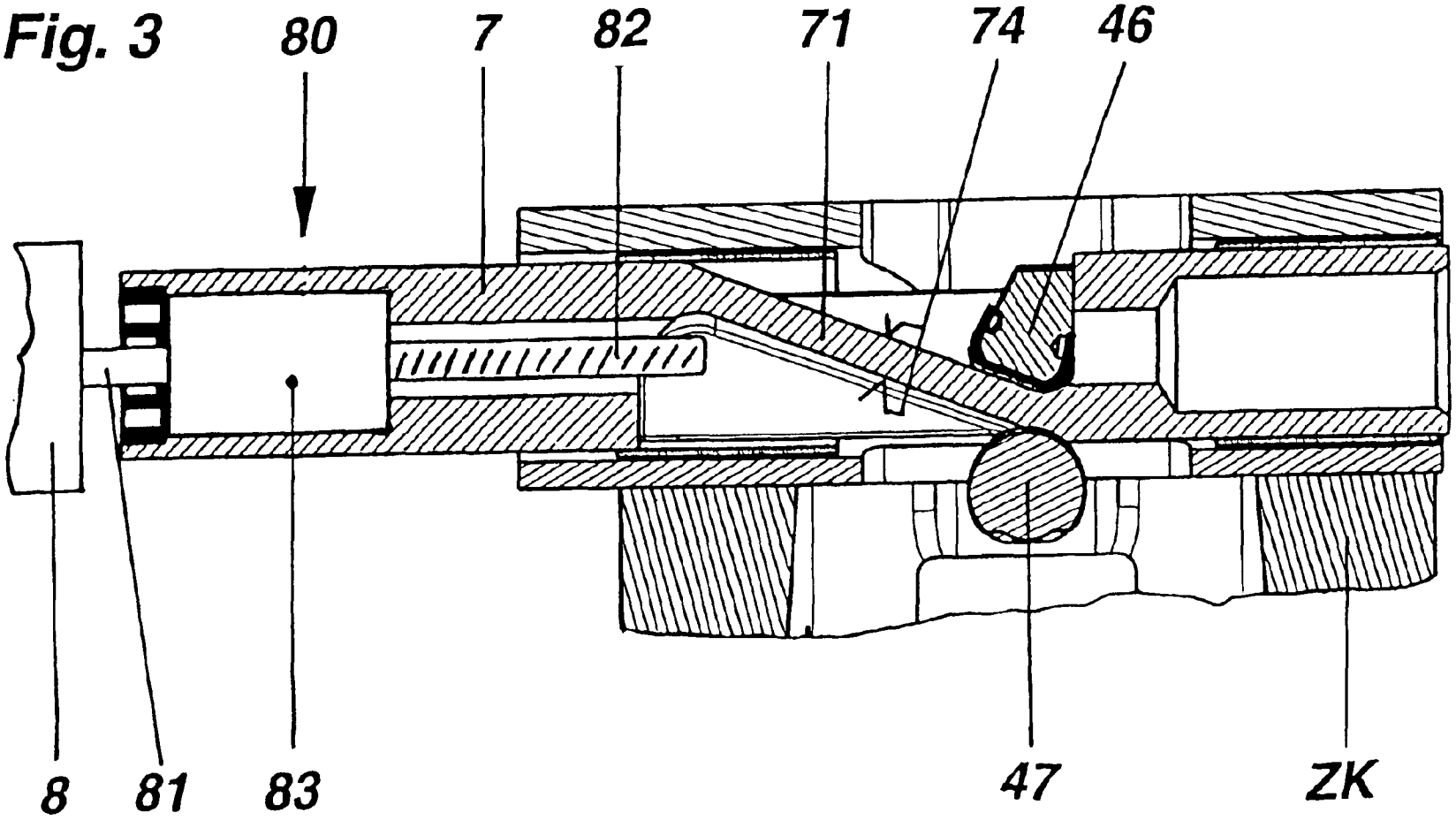
FIG. 3 shows a lengthwise cross-sectional representation of an actuating drive according to the invention, which runs perpendicular to the control surfaces arranged on the actuating slide, and shows the actuating drive in its position for maximum stroke of the valve.

FIG. 3 shows the actuating drive according to the invention in a lengthwise cross-section, which runs perpendicular to control surfaces 74 arranged on actuating slide 7 and comprises the engagement region of actuating lever 45. In this connection, the actuating drive has a setting for maximum valve stroke.

Figure 5:
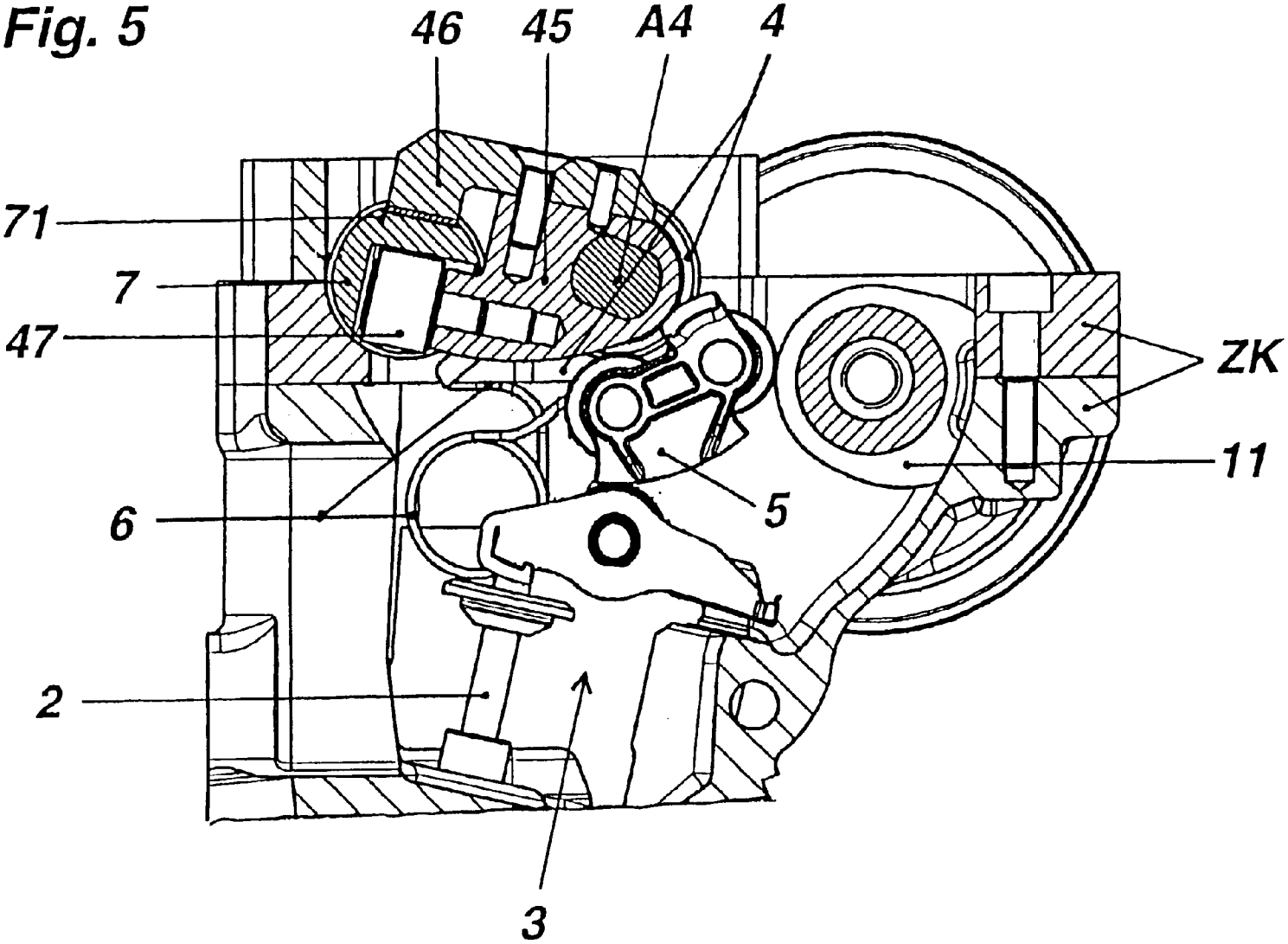
FIG. 5 shows a transverse cross-sectional representation of an actuating drive according to the invention similar to FIG. 2, but with a position of the actuating lever for zero stroke or quasi zero stroke of the valve.

Actuating bridge 71 on actuating slide 7 runs at a slant or in curve shape along the axis and across the crosswise cross-section of actuating slide 7, so that during its axial displacement, actuating lever 45 and with it element 4 is pivoted. See the two end positions of actuating lever 45 in FIG. 2 and FIG. 5.

Figure 4:
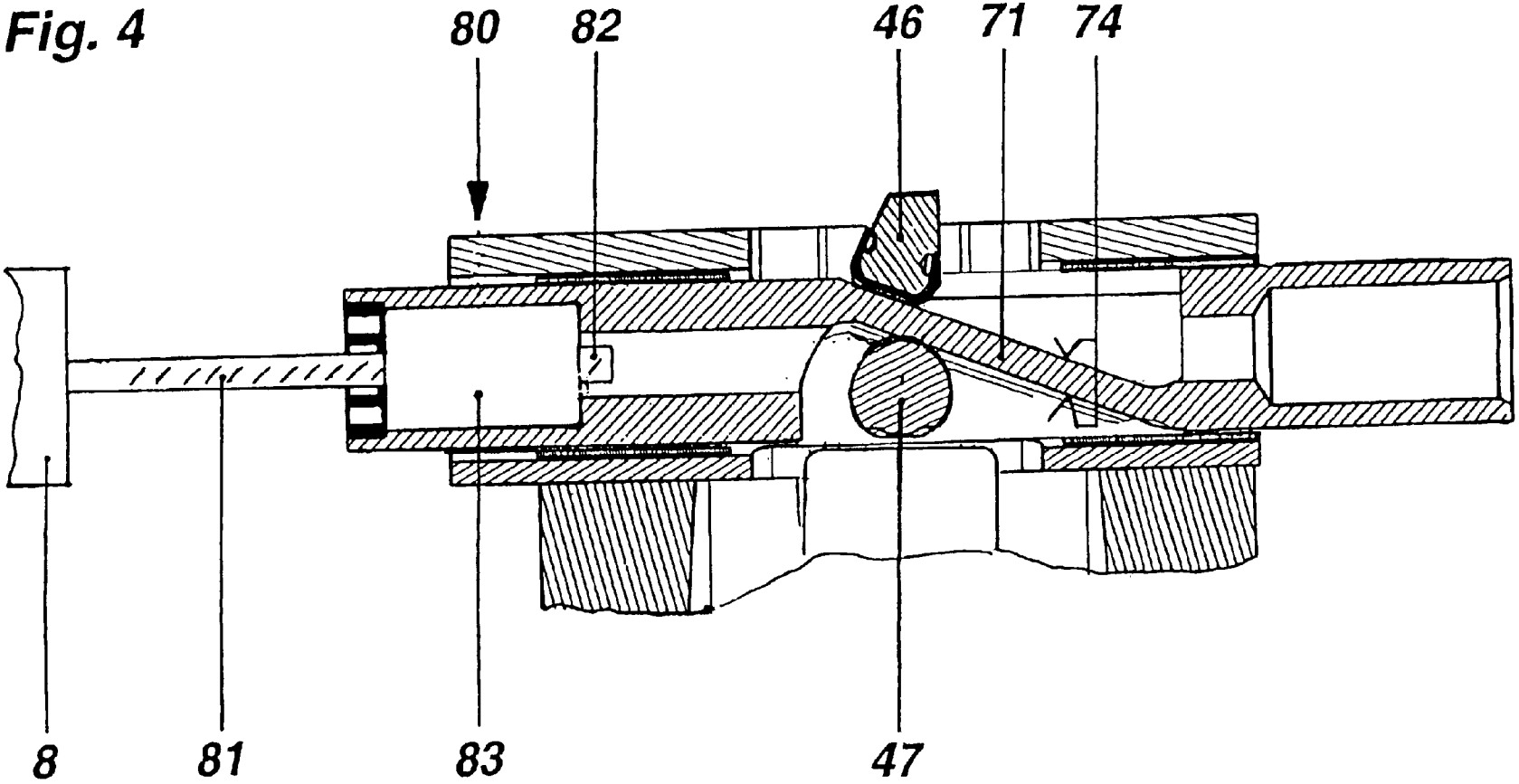
FIG. 4 shows the actuating drive depicted in FIG. 3, but in a position for zero stroke or quasi zero stroke of the valve.

In FIG. 4, actuating slide 7 is displaced to the right as compared with its position in FIG. 3. Actuating lever 45 therefore engages at the control surface or control surfaces 74 of actuating bridge 71 in a different region, with counter-bearing arm 46 and roller 47, and has thereby been pivoted upwards or to the right, together with element 4. See FIG. 5. As a result, element 4 assumes a position that effects zero stroke or the least stroke.

In the case that the control surface or control surfaces 74 of actuating bridge 71 is/are not constructed to rise in linear manner, an adaptation of the engagement contour or engagement contours is necessary, particularly on counter-bearing arm 46 of actuating lever 45. Appropriately curved surfaces must be provided for the engagement contours, in each instance.

It is advantageous if the control surface or control surfaces 74 of actuating bridge 71 is/are constructed so that during displacement towards the maximum stroke of valve 2, the change in the valve stroke changes, relative to the actuating path. As a result of this embodiment, the adjustment is given a greater translation in the region of great valve stroke, when greater actuating forces are required for adjustment.

An actuating drive 80 is constructed as a screw-type drive and is formed by an actuating nut 83 and an actuating shaft 81 having a threaded spindle 82. Actuating nut 83 is attached in actuating slide 7 that is guided by actuating lever 45, in fixed rotational manner.

Actuating shaft 81 having threaded spindle 82 is driven by an actuating motor B arranged on or in the cylinder head in fixed rotational manner.

It is also possible to construct the actuating drive with an actuating cylinder to which pressure can be applied, preferably on both sides, instead of actuating motor 8, which cylinder is then directly coupled with actuating slide 7, not shown. This arrangement could develop into a mechanically stepped-down actuating drive 80.

It is advantageous if spring 6 which engages on intermediate member 5 is supported on changeable element 4. Its actual force generates a torque or support moment on changeable element 4, which effects an adjustment towards greater stroke, and hereby counteracts the moment that is in effect during valve stroke, from the support and guide of intermediate member 5. With this embodiment, the actuating force that is necessary from actuating motor 8 or the actuating cylinder, in the case of an adjustment towards a greater stroke, is reduced.

Actuating shaft 81 has an actuating bridge ?I, which extends axially, in the region of the actuating path, on which control surfaces 74 are present on one or both sides, which are in engagement with actuating lever 45, in a non-positive lock, by way of counter-bearing arm 46 and roller 47. Actuating lever 45 is coupled with element 4 which is changeable in its angle position, in fixed rotational manner. When actuating slide 7 is displaced axially, actuating lever 45 is pivoted, together with the element 4 that is mounted in a fixed location in cylinder head ZK, but so as to rotate, whereby a change in the valve stroke adjustment takes place.

Accordingly, although only a few embodiments of the present invention have been shown and described, it is to be understood that many changes and modifications may be made thereunto without departing from the spirit and scope of the invention as defined in the appended claims.

What is claimed is:

1. An actuating drive for a valve drive having a variable adjustable stroke for activating valves of an internal combustion engine comprising a cylinder head, a plurality of valves arranged in the cylinder head, closable by spring force, and having a respective assigned stroke transfer arrangement for each valve in a fixed position, and a camshaft rotatably mounted in the cylinder head having a camshaft cam and a fixed position relative to the valves and their assigned stroke transfer arrangements, said actuating drive comprising:

(a) a changeable element having a changeable position for valve stroke adjustment pivotally mounted in the cylinder head about a pivot axis fixed in the cylinder head, said changeable element having cams on its circumference;

(b) an intermediate member held in engagement on said cams by a spring force and supported on said cams for guided movements, said intermediate member also being in engagement with the camshaft cam and the stroke transfer arrangement assigned to each valve;

(c) an actuating lever coupled to said element in a fixed rotational manner;

(d) an actuating slide adjacent to the cylinder head and in engagement with said actuating lever, said actuating slide being guided for displacement in the cylinder head and having an actuating bridge, said actuating lever resting on at least one side of said actuating bridge so that pivotal movement of said actuating lever results from displacement of said actuating slide; and (e) an actuating motor coupled to said actuating slide for effecting displacement of said actuating slide and guidance of said actuating lever to a selected angle position in the cylinder head.

2. The actuating drive according to claim 1, wherein aid actuating bridge has at least one control surface with a nonlinear slope.

3. The actuating drive according to claim 2, wherein said at least one control surface is constructed so that during displacement along an actuating path towards a maximum stroke of the valve, a decrease in change in valve stroke results relative to the actuating path.

4. The actuating drive according to claim 1, wherein said actuating slide is arranged on the side of the cylinder head opposite to the camshaft.

5. The actuating drive according to claim 1, wherein a spring supported on said changeable element provides the spring force for engaging said intermediate member on said cams and effects a torque or support moment in a direction of adjustment towards a greater stroke on the changeable element.

6. The actuating drive according to claim 1, further comprising an actuating nut attached to said actuating slide guided in fixed rotational manner by said actuating lever.

7. Actuating drive according to claim 1, wherein said the actuating slide is coupled with a pressure-impacted actuating cylinder, in thrust-resistant manner.

* * * * *